US007070141B2

(12) United States Patent
Paanasalo

(10) Patent No.: US 7,070,141 B2
(45) Date of Patent: Jul. 4, 2006

(54) METHOD FOR CONTROLLING WINDER

(75) Inventor: Jari Paanasalo, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 68 days.

(21) Appl. No.: 10/476,095

(22) PCT Filed: Apr. 19, 2002

(86) PCT No.: PCT/FI02/00328

§ 371 (c)(1),
(2), (4) Date: Oct. 24, 2003

(87) PCT Pub. No.: WO02/088012

PCT Pub. Date: Nov. 7, 2002

(65) Prior Publication Data

US 2004/0135024 A1 Jul. 15, 2004

(30) Foreign Application Priority Data

Apr. 27, 2001 (FI) ..... 20010885

(51) Int. Cl.
*B65H 18/08* (2006.01)

(52) U.S. Cl. ..... 242/534.2; 700/126

(58) Field of Classification Search ..... 242/333.1, 242/333.6, 333.7, 534.2, 563.2; 700/126
See application file for complete search history.

(56) References Cited

U.S. PATENT DOCUMENTS

| | | | | |
|---|---|---|---|---|
| 3,887,122 A | | 6/1975 | Sommeria | |
| 4,285,130 A | | 8/1981 | Chandler | |
| 4,438,889 A | | 3/1984 | Schonmeier | |
| 4,494,203 A | | 1/1985 | Suzuki et al. | |
| 4,535,949 A | | 8/1985 | Olsson | |
| 4,631,682 A | * | 12/1986 | Ng et al. | 700/126 |
| 4,982,104 A | | 1/1991 | Yuito | |
| 5,267,703 A | | 12/1993 | Biagiotti | |
| 5,556,052 A | | 9/1996 | Knaus | |
| 6,550,713 B1 | | 4/2003 | Ruha et al. | |

FOREIGN PATENT DOCUMENTS

| | | |
|---|---|---|
| DE | 195 38 155 A1 | 1/1997 |
| DE | 299 20 463 U1 | 3/2000 |
| DE | 199 05 140 B4 | 6/2004 |
| FI | 80432 | 2/1990 |
| GB | 2 043 298 A | 2/1980 |
| JP | 55-21376 | 2/1980 |
| JP | 7-88549 | 4/1995 |
| JP | 8-81100 | 3/1996 |
| SE | 353 059 | 1/1973 |
| WO | WO 02/088012 A1 | 11/2002 |

OTHER PUBLICATIONS

Search Report issued in Finnish App. No. 20010885.
International Preliminary Examination Report issued PCT/FI02/00328.
International Search Report issued PCT/FI02/00328.

* cited by examiner

*Primary Examiner*—John Q. Nguyen
(74) *Attorney, Agent, or Firm*—Stiennon & Stiennon

(57) ABSTRACT

The stopping of a winder is controlled such that winding is stopped when a desired length of a web has been wound on a roll being formed/unwound from a roll being formed or when the size of the diameter of the roll is desired. An estimated stopping length is calculated based on speed, acceleration and a desired end speed.

13 Claims, 4 Drawing Sheets

Fig. 1. Block diagram illustration:

METHOD FOR CONTROLLING WINDER

CROSS REFERENCES TO RELATED APPLICATIONS

This application is a U.S. National Stage application of International Application No. PCT/FI02/00328, filed Apr. 19, 2002, and claims priority on Finnish Application No. 20010885, Filed Apr. 27, 2001.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to methods for controlling a winder.

In this description, stopping means control of the speed of a winder such that the set target speed is reached at the same instant as the set target length or target diameter in a paper roll being completed or, alternatively, in a paper roll being unwound. If the target speed is zero, the winder stops, but otherwise it continues to run at a new target speed which is slower than the normal running speed.

When a paper or board web that is being completed is wound into a paper roll for customers, paper rolls having a certain diameter or a certain web length are usually needed. Consequently, in the winding process it must be known before the winding is stopped at what stage the winding shall be stopped in order that the roll being completed shall be a roll having a desired diameter or a desired number of meters of web, in which connection in the control of winding it is necessary to know the stopping distance, i.e. the number of meters of web still to be run if stopping is started at the instant in question. Another need of stopping arises when deceleration is performed at a certain location of the roll being unwound (typically a defective area in the roll being unwound) or when there is stopping at the bottom of the roll being unwound before the end of the web is able to be unwound from the roll. The stopping distance is calculated on the basis of an estimated stopping length and the number of remaining meters (target length less actual length) and, in prior art applications, a speed reference is supplied based on this to a rounder, on the basis of which a speed reference is supplied to the drive and, based on this calculation, the set value of speed passed to the rounder is changed upward or downward to control the speed such that winding can be stopped at a desired roll size. This control method known from the state of the art is relatively coarse.

In the prior art arrangements, when stopping takes place according to roll diameter, the paper caliper provided by density measurement has been used in calculation. In the prior art applications, pulse measurements, which are inaccurate and unreliable measurements, have been used in diameter and density measurements.

Moreover, in the prior art methods, taking the delay of the drive into account in the calculation of the estimated stopping length has been somewhat complicated and, in addition, inaccuracies have occurred, in particular if it has been necessary to start deceleration in a situation in which the machine is still accelerating or it has already been in a deceleration phase for some other reason.

In the prior art applications, a "bang-bang" control has been used in controlling deceleration in stopping: either the target value of speed or the target value of deceleration has been switched between two values, and an instantaneous deceleration value has been formed as a mean value. These are coarse and inaccurate means for deceleration control.

With respect to the prior art, reference is made to FI patent No. 80432 (corresponding U.S. Pat. No. 4,631,682), which discloses a method for controlling the operation of a winder, the control system described in the patent providing automatic control of slitter-winder deceleration and stopping at a preset sheet length or a preset roll diameter. This system has used a closed loop control of speed deceleration and automatic compensation for layers removed after a sheet break. This method has been based on the use of two different deceleration values, one of them being used for achieving a desired stopping distance. This prior art method is rather coarse.

SUMMARY OF THE INVENTION

It is an object of the invention to provide a method in which the calculation of the stopping distance of a winder is more accurate than before and which allows the parameters used to have different values (acceleration, deceleration, roundings and end speed).

It is also an object of the invention to provide a method for controlling the winder which does not have the problems of the prior art arrangements and which is more versatile as to its possibilities of use.

In accordance with advantageous features of the method of the invention, when used, the calculation of the number of meters still to be run when stopping is started at the instant in question, i.e. the calculation of the stopping distance is mote accurate than it is in the prior art applications because in it the estimated length is calculated from instantaneous speed, target speed, rounding times, measured instantaneous acceleration/deceleration, target deceleration and drive delay.

The method in accordance with advantageous additional features of the invention allows the parameters used (acceleration, deceleration, roundings and end speed) to have different values. In accordance with advantageous features of the invention, in the calculation of the stopping distance, the actual acceleration value is used which is obtained by differentiating the actual speed value by means of a program. This provides a substantial improvement from the point of view of the control of stopping because, when the drive delay is long, the number of meters caused by the rounding time of actual deceleration becomes a considerable addition to the estimated stopping length.

In the method in accordance with advantageous additional features of the invention, deceleration is solved iteratively based on the estimated stopping length and the number of remaining meters (target length–actual length), thereby achieving correct stopping. The thus obtained reference value deceleration is passed to the rounder of the speed reference, which calculates the speed reference to be passed to the drive. When desired, the deceleration reference can also be passed directly to the drive. In the method, the speed reference is formed for the drive such that the rate of change of acceleration/deceleration is constant=target deceleration/rounding time. Acceleration is constant, but deceleration can vary according to stopping calculation. The rounding times may have different target values in the starting and stopping of deceleration.

An exception to these rules is a situation where the phase of controlled deceleration is not reached but the speed reference is at rounding during the whole time of deceleration. This situation may arise when the change of speed is small and the rounding times are long. In this situation, iteration cannot solve the deceleration value because there is no time to reach it, but, instead, it solves the values of starting/end rounding, by means of which correct stopping is achieved.

Alternatively, in the method in accordance with the invention, to determine deceleration, the deceleration could be explicitly solved from an estimated stopping length equation, by which the same end result is obtained in practice. However, an iterative arrangement is used in an advantageous embodiment of the invention because programwise it is simpler and easier to understand. Iteration can be considered to be a unit controller of deceleration or, alternatively, a stochastic approximation.

When the method in accordance with the invention is used for stopping according to a desired diameter, the remaining diameter difference is converted into the number of remaining meters for calculating the estimated stopping length. This takes place by using measured diameter, core diameter and measured length by means of proportions. Thus, determination is simple and reliable in operation. The error which is found in the calculated value and which comes from diameter measurement becomes smaller towards the end and the stopping method compensates for it effectively, enabling accurate stopping even though there would be noise in measurements. The target diameter is converted into a target length as follows:

$$\text{Stop length} = \text{Measured length} \cdot \frac{(\text{Stop } diameter^2 - \text{Core } diameter^2)}{(\text{Measured } diameter^2 - \text{Core } diameter^2)}$$

The stopping method in accordance with the invention enables accurate stopping at any desired end speed such that, when reaching the end speed, the target diameter or the target length is reached. The end speed can be, for example, zero, the speed during roll change in winding or a desired deceleration rate in unwinding when passing an area of poor quality.

In the stopping method in accordance with the invention, stopping can be accomplished accurately also in the case when deceleration has to be started when the machine is still accelerating or when it is already decelerating for some other reason. This is based on the accurate calculation of the estimated stopping length described above and advantageously on the use of the actual acceleration value in it.

In the stopping method in accordance with the invention, the drive delay is taken into account in calculating the estimated stopping length by adding it to the stopping time (multiplied by two). This is a significant improvement also when accelerating while stopping is going on.

In accordance with an advantageous additional feature, the stopping method in accordance with the invention can itself measure the drive delay every time the machine performs acceleration or deceleration at a constant acceleration rate. In the method in accordance with the invention, the drive delay is the only tuning parameter that is thus automatically obtained in the method as measured by the program itself. Thus, tuning is quick and reliable, and the measured drive delay shows at the same time how well the drive follows the speed reference. The variable deceleration rate used in the method makes the inertia compensation of the drive in unwinding for tension control somewhat more difficult. This problem has been advantageously solved such that on the drive side there is always a filter in the handling of the speed reference, which, on the one hand, limits changes in speed and, on the other hand, provides an accurate deceleration value for inertia compensation. Here, it is possible to advantageously use, for example, a 4-second Finite Impulse Response filter, which provides a drive delay of about 2 seconds and enables good operation of stopping.

In the invention, reaching the target deceleration rate is based on the fact that, in accordance with an advantageous additional feature, stopping is started at the correct instant, including the drive delay. If the instant of starting deceleration is delayed, for example, because of an error in diameter measurement, the final stopping is nevertheless still accurate, but in that case the reference deceleration solved by iteration will be higher than the target value. Similarly, the deceleration started too early leads to a lower deceleration rate. If in connection with the method in accordance with the invention, accurate stopping is desired based on unreliable measurements, the value of the absolute maximum deceleration is used which is slightly higher than the target deceleration.

In the method in accordance with the invention, the stopping of the winding process is advantageously performed based on the diameter provided by linear sensors of winding stations and on the web length received from pulse measurement. When the method in accordance with the invention is used in connection with unwinding, stopping operations can be performed without pulse measurements if the exact diameter is available which has been measured, for example, by an ultrasonic sensor.

In the automatic stopping method in accordance with the invention, the estimated length is advantageously calculated first based on speed, acceleration, rounding times and end speed. The estimated length obtained indicates how many web meters would still accumulate if stopping started now. After that, a comparison is made whether the calculated estimated length is equal to or greater or less than the number of remaining meters or whether stopping is going on. If the situation does not yet call for it, the desired running speed is maintained. If the number of remaining meters is smaller than the estimated stopping length, stopping is started and the desired end speed is set as the target speed instead of the running speed. After that, the estimated length and the number of remaining meters are again compared with each other and, based on the result obtained, the deceleration rate is either increased or decreased. If the calculation of the estimated length shows that there is no time to reach this deceleration value, a corresponding increase/decrease is made to rounding times. After that, a rounded speed reference value is generated for the electric drive, using the target speed, the reference deceleration rate/reference acceleration rate and the desired end speed as reference values. When the target has been reached, i.e. the number of remaining meters is zero, stopping and the number of meters run are zeroed and, when commanded, running is re-started. The control cycles according to the invention are carried out at desired intervals using, for example a cycle of 100 ms.

In the following, the invention will be described in greater detail with reference to the figures of the accompanying drawing, but the invention is by no means meant to be narrowly confined to the details of the figures.

DESCRIPTION OF THE PREFERRED EMBODIMENTS

Figure 4:
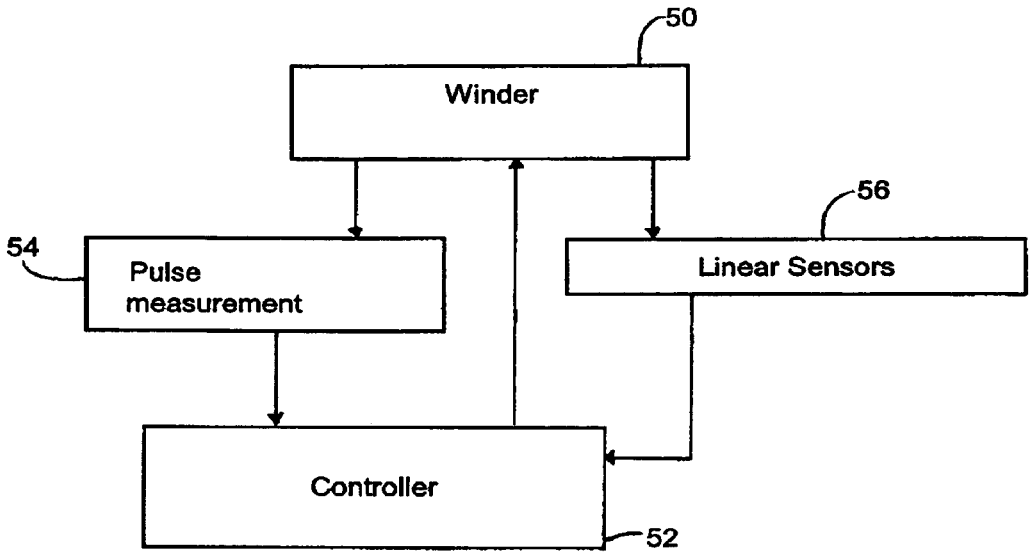
FIG. 4 shows a block diagram of a winder sensors' inputs to a controller.

As shown in FIG. 4, a winder 50 controlled by a controller 52 is shown. The controller can receive inputs from a pulse measurement 54, and from linear sensors 56 which provide input to the controller.

Figure 1A:
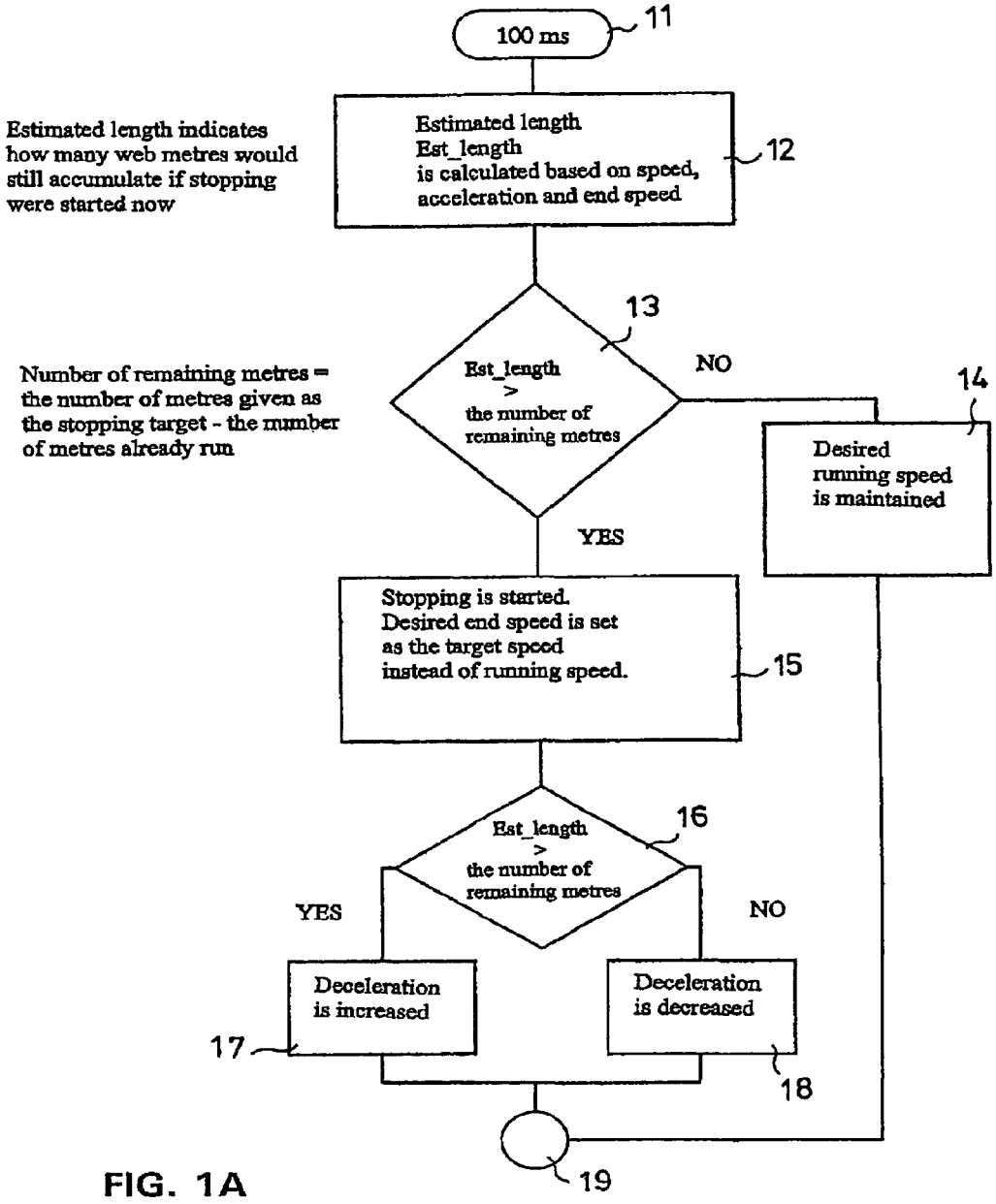
FIGS. 1A and 1B show schematic block diagrams of the automatic stopping method in accordance with the invention.
Figure 1B:
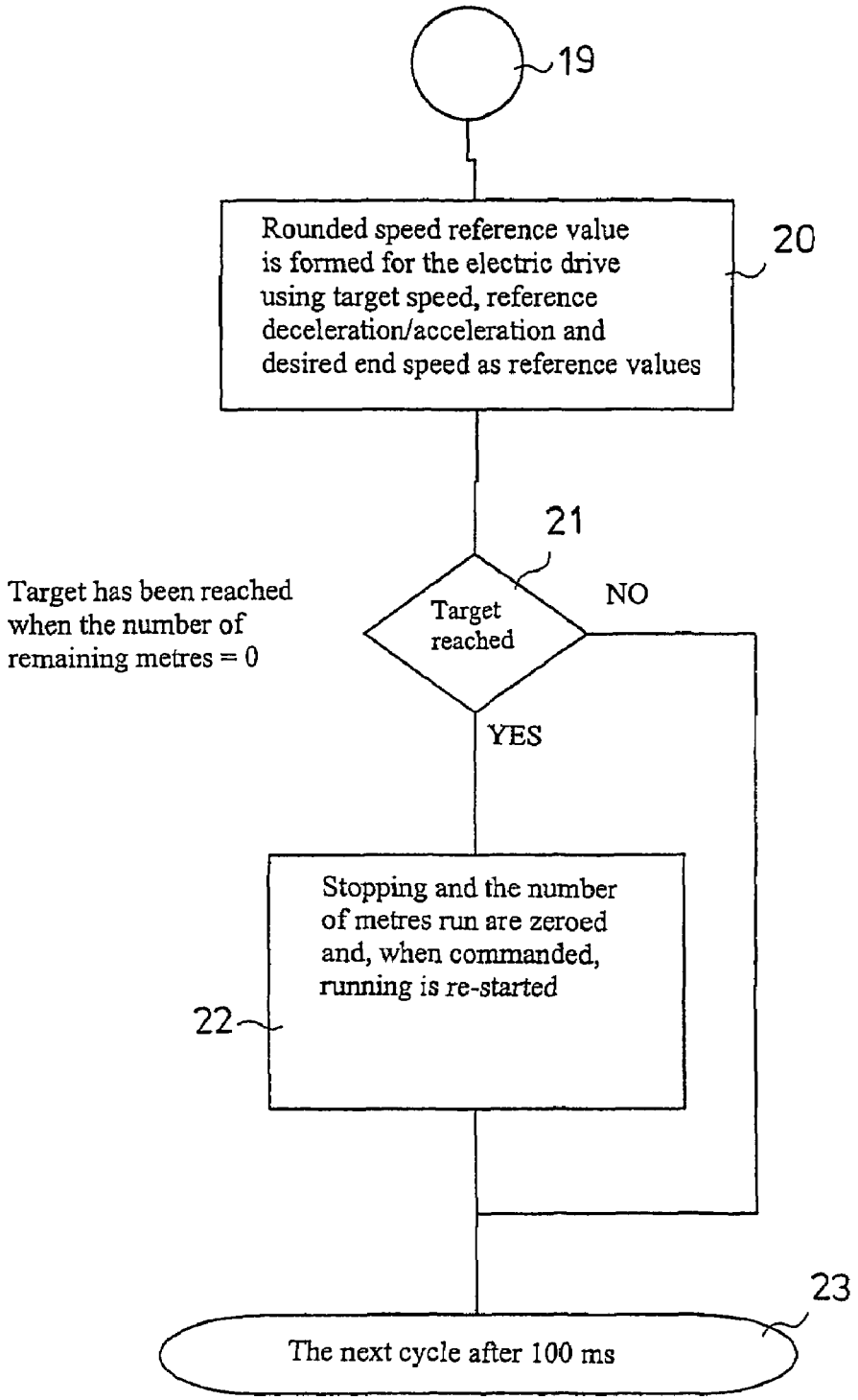

As shown in FIGS. 1A and 1B, an automatic stopping cycle between blocks 11 and 23 is always carried out after a desired interval using, for example, a cycle of 100 ms. In the block 12, an estimated length is calculated based on speed, acceleration and end speed. The estimated length indicates how many web meters would still accumulate if stopping started now. In the block 13, the estimated length is compared with the number of remaining meters and it is checked whether stopping is already going on. If this is not the case, there is a transition to the block 14 and the desired running speed is maintained. If the estimated length is greater than the number of remaining meters or if stopping is already going on, there is a transition to the block 15 and stopping is started/stopping is continued and the desired end speed is set as the target speed instead of the running speed. The number of remaining meters means the number of meters given as the stopping target less the number of meters already run. In the block 16, the estimated length is compared with the number of remaining meters and, in accordance with it, either the block 17 or 18 is chosen and deceleration is increased or decreased according to whether the estimated length is greater or smaller than the number of remaining meters. After the block 19 there is a transition to the block 20, in which a rounded speed reference value is formed for the electric drive by using the target speed, the reference deceleration/acceleration and the desired end speed as reference values. In the block 21, it is checked whether the target has already been reached, i.e. whether the number of remaining meters is equal to zero. If this is not the case, there is a transition to the next cycle through the block 23. If the target has been reached, stopping and the number of meters run are zeroed and, when commanded, running is re-started.

In the method in accordance with the invention, calculation is carried out using the following formulas in accordance with the block diagram described above.

Speed equation:

$$\int_0^{\frac{\text{Set_deceleration}-\text{Actual_deceleration}}{\text{Drive_rounding1}}} (-\text{Drive_rounding1}\cdot t-\text{Actual_deceleration})\,dt + \int_0^{T}(-\text{Set_deceleration})\,dt + \int_0^{\frac{\text{Set_deceleration}}{\text{Drive_rounding2}}} (\text{Drive_rounding2}\cdot t-\text{Set_deceleration})\,dt + \text{Actual_speed}=\text{End_speed}$$

Speed equation explicitly:

$$\frac{1}{2}\frac{-\text{Set_deceleration}^2+\text{Actual_deceleration}^2}{\text{Drive_rounding1}} - T\cdot\text{Set_deceleration} - \frac{1}{2}\frac{\text{Set_deceleration}^2}{\text{Drive_roundin2}} + \text{Actual_speed}=\text{End_speed}$$

Deceleration time solved:

$$T=\frac{1}{2}(-\text{Drive_rounding2}\cdot\text{Set_deceleration}^2+\text{Drive_rounding2}\cdot \text{Actual_deceleration}^2-\text{Set_deceleration}^2\cdot\text{Drive_rounding1}+ 2\text{Actual_speed}\cdot\text{Drive_rounding1}\cdot\text{Drive_rounding2}- 2\text{End_speed}\cdot\text{Drive_rounding1}\cdot\text{Drive_rounding2})/ (\text{Drive_rounding1}\cdot\text{Drive_rounding2}\cdot\text{Set_deceleration})$$

Deceleration rate solved when set deceleration was not reached:

$$\text{Set_deceleration}=\sqrt{(\text{Drive_rounding1}+\text{Drive_rounding2})\text{Drive_rounding2}\cdot(-2\text{End_speed}\cdot\text{Drive_rounding1}+\text{Actual_deceleration}^2+2\text{Actual_speed}\cdot\text{Drive_rounding1})}$$

Length equation:

$$\int_0^{\frac{\text{Set_deceleration}-\text{Actual_deceleration}}{\text{Drive_rounding1}}}\int(-\text{Drive_rounding1}\cdot t-\text{Actual_deceleration})\,dt\,dt + \int_0^{T}\left(\int(-\text{Set_deceleration})\,dt + \int_0^{\frac{\text{Set_deceleration}-\text{Actual_deceleration}}{\text{Drive_rounding1}}}(-\text{Drive_rounding1}\cdot t-\text{Actual_deceleration})\,dt\right)dt +$$

-continued $$\int_0^{\frac{\text{Set_deceleration}}{\text{Drive_rounding2}}} (\text{Drive_rounding2}\cdot t - \text{Set_deceleration})\,dt + \int_0^{\frac{\text{Set_deceleration}-\text{Actual_deceleration}}{\text{Drive_rounding1}}} (-\text{Drive_rounding1}\cdot t - \text{Actual_deceleration})\,dt + \int_0^{T} (-\text{Set_deceleration})\,dt\,dt + \int_0^{\frac{\text{Set_deceleration}-\text{Actual_deceleration}}{\text{Drive_rounding1}}+T+\frac{\text{Set_deceleration}}{\text{Drive_rounding2}}} (\text{Actual_speed})\,dt = \text{Est_length}$$

The length equation is obtained from the speed equation by integration with respect to time. The additional terms inside the four integral components are needed for continuity.

Length equation explicity in the four components:

$$\text{temp1} = -\frac{1}{6}\frac{\text{Set_deceleration}^3}{\text{Drive_rounding1}^2} + \frac{1}{2}\frac{\text{Set_deceleration}\cdot\text{Actual_deceleration}^2}{\text{Drive_rounding1}^2} - \frac{1}{3}\frac{\text{Actual_deceleration}^3}{\text{Drive_rounding1}^2}$$

$$\text{temp2} = -\frac{1}{2}\text{Set_deceleration}\cdot T^2 - \frac{1}{2}\frac{T\cdot\text{Set_deceleration}}{\text{Drive_rounding1}} + \frac{1}{2}\frac{T\cdot\text{Actual_deceleration}^2}{\text{Drive_rounding1}}$$

$$\text{temp3} = -\frac{1}{3}\frac{\text{Set_deceleration}^3}{\text{Drive_rounding2}^2} - \frac{1}{2}\frac{\text{Set_deceleration}^3}{\text{Drive_rounding2}\cdot\text{Drive_rounding1}} + \frac{1}{2}\frac{\text{Set_deceleration}\cdot\text{Actual_deceleration}^2}{\text{Drive_rounding2}\cdot\text{Drive_rounding1}} - \frac{T\cdot\text{Set_deceleration}^2}{\text{Drive_rounding2}}$$

$$\text{temp4} = \frac{\text{Actual_speed}\cdot\text{Set_deceleration}}{\text{Drive_rounding2}} - \frac{\text{Actual_speed}\cdot\text{Actual_deceleration}}{\text{Drive_rounding1}} + \text{Actual_speed}\cdot T + \frac{\text{Actual_speed}\cdot\text{Set_deceleration}}{\text{Drive_rounding2}}$$

Figure 2:
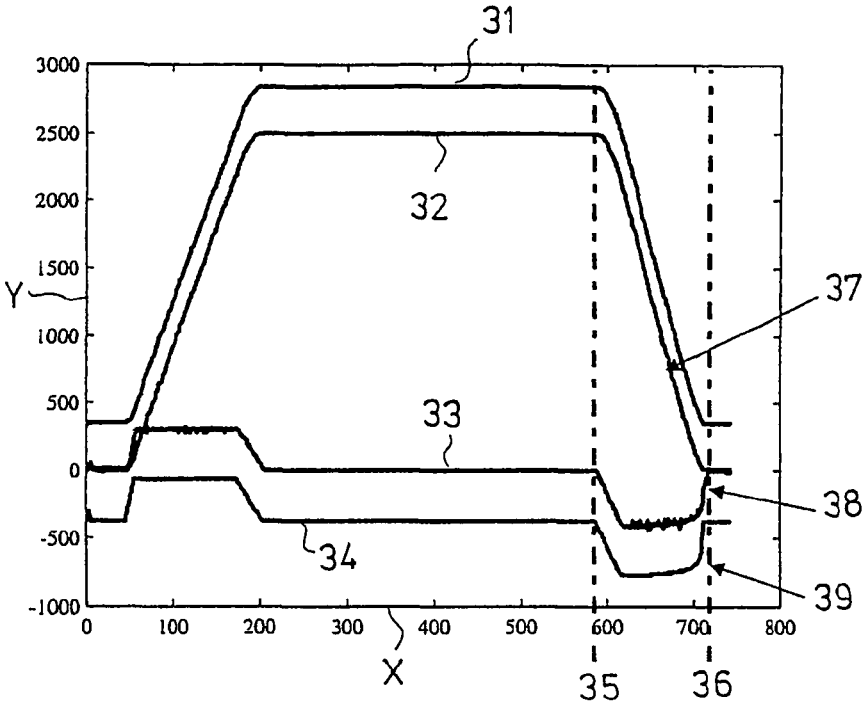
FIG. 2 shows curves on a graph concerning speed reference, actual speed as well as acceleration reference and actual acceleration values.

FIG. 2 shows curves relating to a speed reference and actual speed as well as to an acceleration reference and actual acceleration. The Y axis represents speed and acceleration (figures multiplied by a thousand) and the X axis represents running time. The reference numeral 35 designates the instant when stopping is started and the reference numeral 36 designates a situation in which the target has been reached. In accordance with the speed reference of the curve 31, the actual speed values 32 follow the speed reference. The point indicated by the reference numeral 37 shows how the electric drive follows the speed reference as a slave. The actual acceleration curve is designated by the reference numeral 33 and the acceleration reference is designated by the reference numeral 34. The point 38 shows how there is measurement noise in acceleration conditions, and the reference numeral 39 designates a situation in which the acceleration reference is controlled in accordance with stopping. As seen from the curves, the actual speed value follows the speed reference very well and the actual acceleration value also follows the acceleration reference very well. The curves in FIG. 2 have been shifted in the vertical direction to improve readability.

Figure 3:
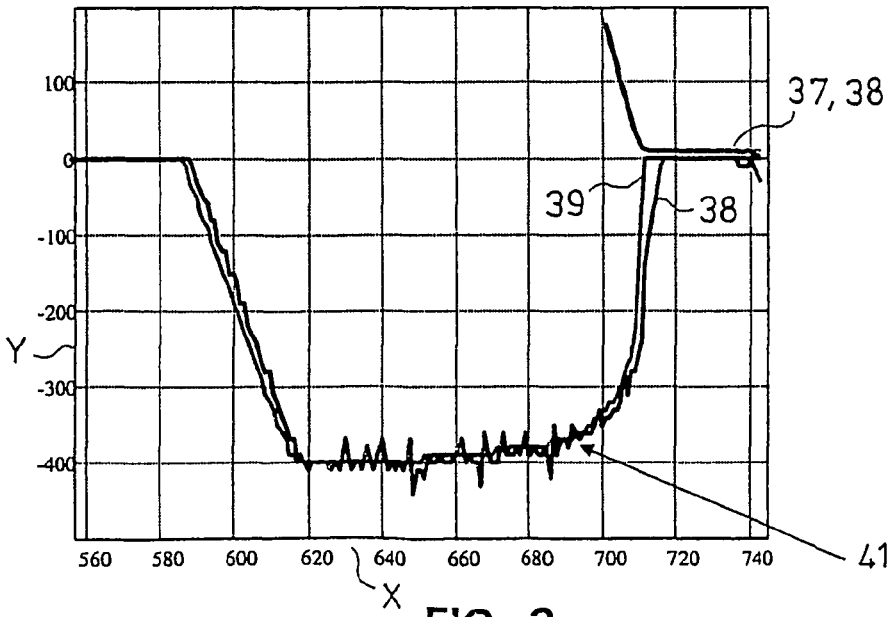
FIG. 3 shows deceleration during stopping as curves on a graph.

FIG. 3 schematically shows deceleration during stopping, the Y axis representing deceleration and the X axis representing running time. In other words, this is, in a way, a partial enlargement of the end situation shown in FIG. 2 in which the curves 31, 32, 33, 34 are placed in their correct positions without a vertical shift. In the situation of FIG. 3, the target deceleration has been −0.4, and the point 41 shows how deceleration has been reduced in order not to run past the set target value.

Above, the invention has been described with reference to some of its advantageous embodiments only, but the invention is by no means intended to be narrowly confined to the details of the embodiments.

The invention claimed is:

1. A method for controlling a winder, comprising the steps of:

calculating an estimated stopping length with a computer program based on speed, acceleration, and a desired end speed as well as rounding times associated with the speed, the acceleration and the desired end speed, of a web being wound or unwound into or from a paper roll; and controlling stopping of the winder such that winding is stopped on a condition selected from a first group consisting of: when a desired length of the web has been wound on a roll being formed, when a desired length of the web has been unwound from a roll, and when the roll being formed is of a desired diameter, wherein the controlling stopping of the winder is based on the estimated stopping length.

2. The method of claim 1, wherein in the step of calculating an estimated stopping length, the computer program uses an actual acceleration value for the acceleration, the acceleration being calculated by differentiating the speed, wherein said speed is actual speed.

3. The method of claim 1, wherein in the step of calculating an estimated stopping length, the acceleration is a deceleration, and wherein the deceleration is solved for iteratively based on the estimated stopping length to achieve the condition selected from the first group.

4. The method of claim 1, wherein the rounding times are solved iteratively based on the estimated stopping length and a number of remaining meters needed to achieve the condition selected from the first group.

5. The method of claim 1, wherein the winder has a drive and a speed reference is passed to the drive, and wherein the speed reference is calculated based on the acceleration which is a continuously variable acceleration which is a deceleration.

6. The method of claim 1, wherein the continuously variable acceleration is a continuously variable deceleration which is determined explicitly by solving for a continuously variable deceleration from an estimated stopping length equation.

7. The method of claim 1, wherein the stopping of the winder is according to a desired diameter, and a remaining diameter difference is determined and is converted into a number of remaining meters for comparisons to estimated stopping length by using a measured diameter of the paper roll, a diameter of a core on which the paper roll is wound, and a measured length of the paper web.

8. The method of claim 1, wherein the winding is stopped at a desired end speed.

9. The method of claim 1, wherein the stopping is started when the estimated stopping length is greater than a remaining length.

10. The method of claim 1, wherein the stopping of winding is performed in winding based on a diameter provided by linear sensors on the winder and on a web length obtained by pulse measurement.

11. The method of claim 1 wherein the stopping of the winder is based on a diameter and a web length provided by a sensor.

12. The method of claim 1, wherein a drive delay is taken into account in calculation of the stopping time.

13. The method of claim 1 wherein the step of calculating an estimated stopping length with a computer program is further based on actual acceleration, drive delay and end speed, and further comprising the steps of:

comparing the estimated stopping length with a stopping target expressed as a length given from the condition selected from the first group as a stopping target and, if the estimated stopping length is equal to or smaller than the stopping target expressed as a length, stopping is started and a desired end speed is set as a target speed;

calculating a remaining length needed to achieve the stopping target expressed as a length;

if stopping is started, continuously decreasing or continuously increasing the deceleration according to whether the estimated stopping length is smaller or greater than the stopping target expressed as a length;

forming a speed reference value for an electric drive using as reference values the target speed, reference deceleration, acceleration, rounding times and the desired end speed; and when the remaining length is zero, the estimated stopping length and remaining length are zeroed; and running is restarted or running is continued at the target speed which has been reached.

* * * * *